United States Patent [19]

Scioscia

[11] Patent Number: 4,852,876

[45] Date of Patent: Aug. 1, 1989

[54] TENNIS NET HEIGHT EXTENDER

[76] Inventor: David M. Scioscia, 2506A Chapel Hill Rd., Durham, N.C. 27707

[21] Appl. No.: 239,531

[22] Filed: Sep. 1, 1988

[51] Int. Cl.[4] ..... A63B 69/38

[52] U.S. Cl. ..... 273/29 A

[58] Field of Search ..... 273/29 A, 411

[56] References Cited

U.S. PATENT DOCUMENTS

| | | | |
|---|---|---|---|
| 3,105,682 | 10/1963 | Ahrens | 272/59 |
| 3,953,029 | 4/1976 | Boyd | 273/411 X |
| 3,966,205 | 6/1976 | Schain et al. | 273/29 A |
| 3,993,306 | 11/1976 | Scott | 273/29 A |
| 4,135,716 | 1/1979 | Ginsburg | 273/29 A |
| 4,204,679 | 5/1980 | Kreuzman | 273/29 A |
| 4,243,221 | 1/1981 | Ferreira-Godhinho | 273/29 A |
| 4,436,304 | 3/1984 | Castleman et al. | 273/29 A |
| 4,720,112 | 1/1988 | Stettner et al. | 273/411 |

*Primary Examiner*—William H. Grieb

*Attorney, Agent, or Firm*—Webb, Burden, Ziesenheim & Webb

[57] ABSTRACT

A tennis net height extender adapted to be used with a regulation tennis net and tennis net posts situated within a tennis court. The present invention includes a pair of auxiliary tennis net posts each having at least one open faced slot extending from a bottom end of the auxiliary tennis net posts for permitting a rope attached to the tennis net to pass therethrough. The auxiliary tennis net posts are releasably fastenable to the tennis posts so that they extend thereabove. An auxiliary tennis net having an upper longitudinal edge and a lower longitudinal edge has its upper longitudinal edge fastened to the auxiliary tennis net posts so that its lower edge overlaps an upper edge of the tennis net when the auxiliary tennis net posts are attached to the tennis net posts.

20 Claims, 2 Drawing Sheets

TENNIS NET HEIGHT EXTENDER

BACKGROUND OF THE INVENTION (1) Field of the Invention

This invention relates to tennis teaching aids and, more particularly, to a device useable on a tennis court in combination with a standard tennis net and tennis net posts to encourage players to routinely hit the ball over the tennis net.

(2) Description of the Prior Art

In playing tennis, balls are hit over the tennis net from one side of the court to the other. It is necessary to hit the ball over the tennis net but still keep it within the confines of the end line. A problem that occurs is tennis players tend to try to hit the ball too close to the top of the tennis net which often results in hitting the net. Various inventions have been employed to improve the accuracy of the tennis player hitting tennis balls above the tennis net. One such invention is disclosed in U.S. Pat. No. 4,436,304 to Castleman et al. in which a white band is placed a distance above the tennis net. The player then uses the white band as a target to accurately keep the ball in play. A problem with this invention is that players can hit the ball above or below the white band to keep the ball in play which in turn makes it ineffective as a teaching aid. It also encourages aiming for the band and not the back of the court.

It is an object of my present invention to improve a tennis player's accuracy in placing the ball within the tennis court by rewarding the tennis player only when he or she hits the tennis ball a safe minimum distance above the tennis net.

A further object of my invention is to make the player aware of the fact that the top of the net was never meant to be a target. Rather it is a minimum height the ball must attain in addition to landing within the confines of the court. There is no limit on the height the ball can attain as long as it lands within the confines of the court.

U.S. Pat. Nos. 4,243,221 to Ferreira-Godinho, 4,204,679 to Kreuzman and 3,966,205 to Schain et al. all disclose apparatuses to improve a tennis player's game and more particularly the serve, but all require extensive hardware and/or modified existing structure. U.S. Pat. No. 3,993,306 to Scott discloses a tennis target structure that straps to the side of the tennis net. This makes it difficult to align the target with respect to the tennis net.

Thus, it is another object of the present invention to provide a device that can easily be aligned with and attached to an existing tennis pole and tennis net structure so that tennis players can improve their game on an existing tennis court.

Another object of the present invention is to provide a device which is simple in construction, inexpensive, easy to install and simple to operate.

Other objects of the invention will be apparent from the following detailed description of the preferred embodiment and from the accompanying drawings.

SUMMARY OF THE INVENTION

The tennis net height extender of the present invention is adapted to be used with a regulation tennis net and tennis net posts situated within a tennis court. It includes a pair of auxiliary tennis net posts each having at least one open faced slot extending from a bottom end of the auxiliary tennis net posts for permitting a cable attached to the tennis net to pass therethrough. The auxiliary tennis net posts are equipped with devices that permit them to be releasably fastened to the tennis net posts so that they extend thereabove and are adjustable therewith. An auxiliary tennis net is provided and is fastened to the auxiliary tennis net posts in overlapping relationship to the permanent net.

DESCRIPTION OF THE PREFERRED EMBODIMENT

Figure 1:
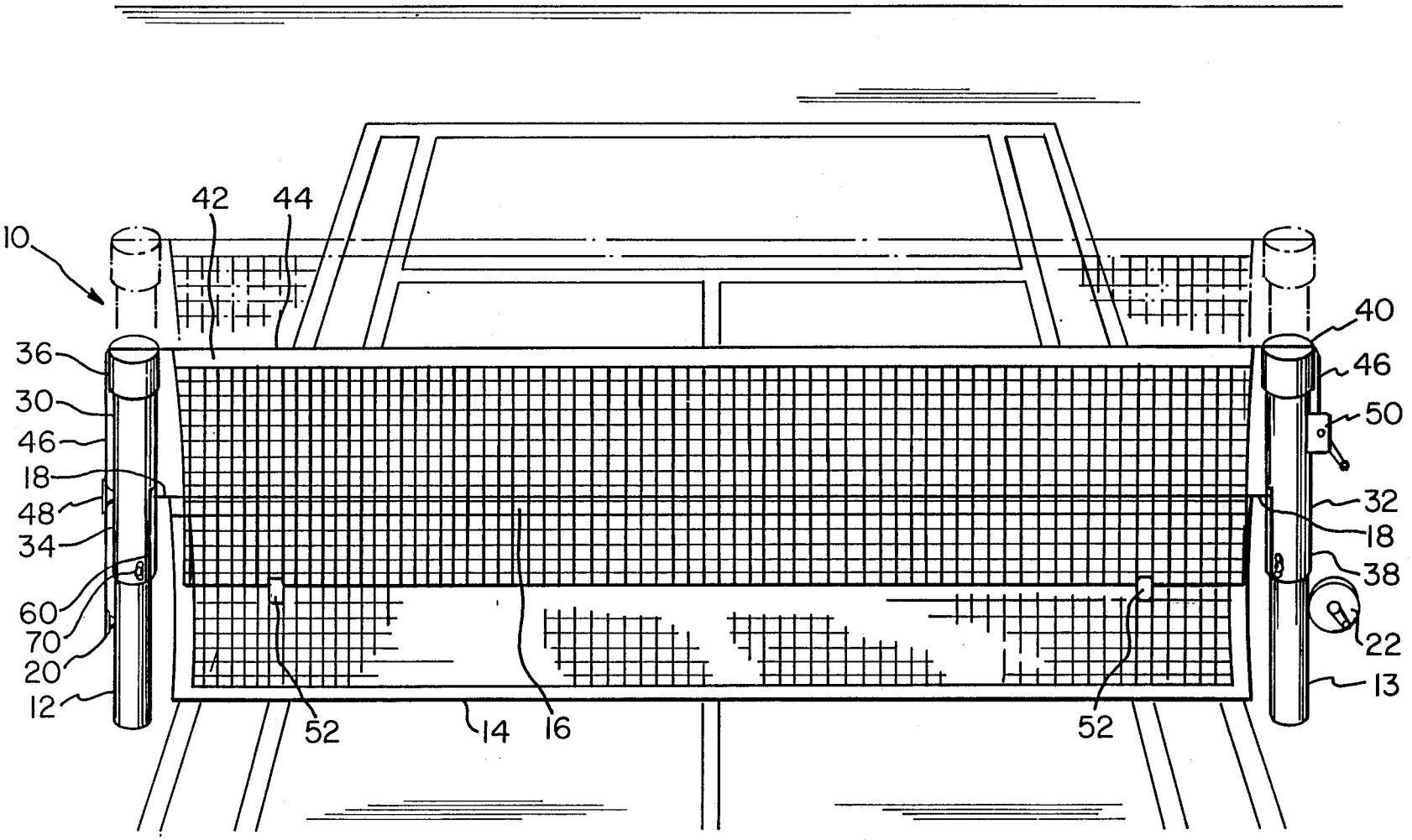
FIG. 1 is a perspective view of a portion of a tennis court with a tennis net height extender applied thereto.
Figure 3:
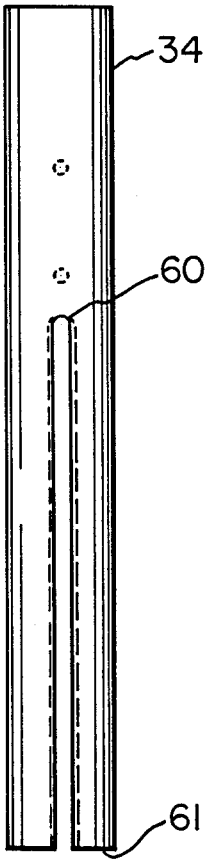
FIG. 3 is a side view of an auxiliary tennis net post of the present invention.
Figure 4:
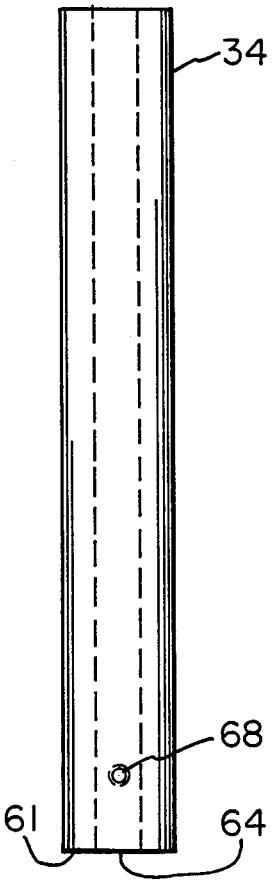
FIG. 4 is another view of the post shown in FIG. 3.
Figure 5:
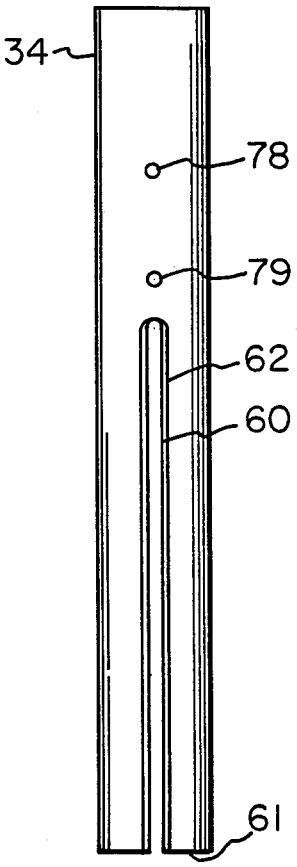
FIG. 5 is yet another view of the post shown in FIG. 3.

FIG. 1 shows a tennis court equipped with a tennis net height extender 10. The court includes two standard net posts 12, 13, between which is stretched a standard tennis net 14 having a white top band 16. A cable 18 extends through top band 16 and its left-hand end is fastened to net post 12 through a cleat 20. The right-hand end of cable 18 is attached to net post 3 through a standard net tensioning mechanism, such as a crank and ratchet mechanism 22. It will be recognized that the term cable includes rope or other form of strand used to hold and tension tennis nets.

Figure 2:
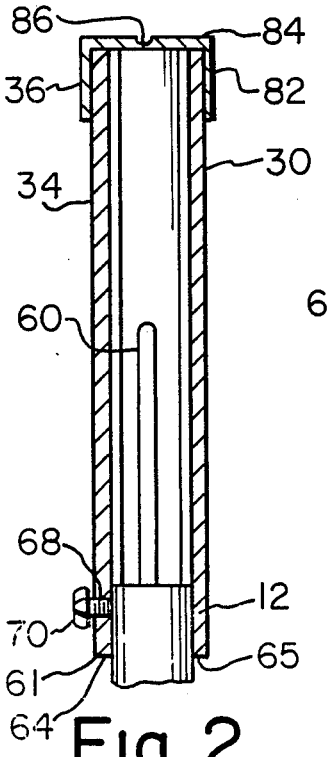
FIG. 2 is a partial cross-sectional view of a portion of the tennis net height extender positioned on a tennis net post.
Figure 6:
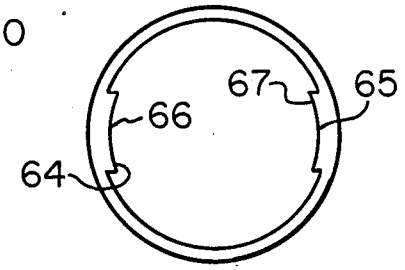
FIG. 6 is a bottom view of the post shown in FIG. 3.
Figure 7:
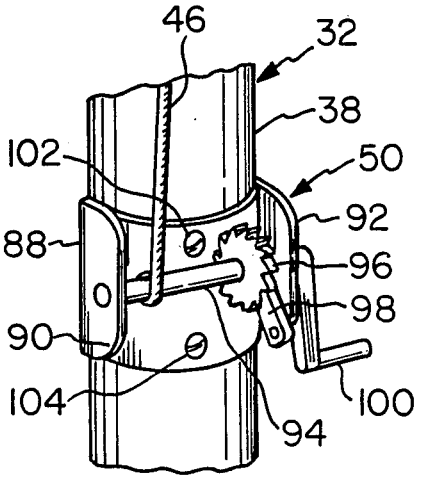
FIG. 7 is a view of a portion of the present invention showing an auxiliary net tensioning device.

The tennis net height extender 10 generally includes two auxiliary tennis net posts 30, 32 attached to net posts 12, 13, respectively. Auxiliary tennis net post 30 includes a cylindrical hollow body 34 and a cap 36 attached thereto as shown in FIG. 2. Likewise, auxiliary tennis net post 32 includes a cylindrical hollow body 38 and a cap 40 attached thereto. Auxiliary tennis net posts 30, 32 extend upwardly beyond tennis net posts 12, 13 and are releasably and adjustably connected thereto so that the tennis net height extender 10 may be quickly and easily set up and taken down. An auxiliary tennis net 42 is provided and has a white top band 44 that is similar to top band 16 running across an upper edge of auxiliary tennis net 42. An auxiliary cable 46 extends through auxiliary top band 44 where its left-hand end is fastened to auxiliary tennis net post 30 through an auxiliary cleat 48. The right-hand end of cable 46 is attached to auxiliary tennis net post 32 through an auxiliary net tensioning mechanism 50, such as illustrated in FIGS. 1 and 7. The actual construction of auxiliary tennis net posts 30, 32 are similar to each other and the posts are generally interchangeable depending upon the attachments provided.

As shown in FIGS. 2–6, each net post 30, 32 includes an open faced axially aligned U-shaped slot 60 extending vertically from a bottom edge 61 of body 34. A second open faced axially aligned U-shaped slot 62 is positioned directly opposite slot 60 and also extends vertically from the bottom edge 61 of body 34. The width of slots 60, 62 are sufficient to permit cable 18 to pass through auxiliary tennis net post 30. The inside diameter of body 34 is greater than the outside diameter of tennis net post 12. Two axially extending tabs or ribs 64, 65 (see FIG. 6) are attached to body 34 and extend from a bottom edge 61 the length of body 34 and also extend inwardly therefrom, so that the bottom end of auxiliary tennis net post 30 is snugly held onto tennis net post 12. Tabs 64, 65 also add structural rigidity to body 34. It is not necessary though that tabs 64, 65 extend the entire length of body 34. Tabs 64, 65 face each other and are positioned intermediate of slots 60, 62. Tab 64 has an arcuate shaped inner surface 66 and, likewise, tab 65 has an arcuate shaped inner surface 67. More particularly, inner surfaces 66, 67 of tabs 64, 65 are arcs of a circle having a diameter approximately equal to, but less than, the outer diameter of post 12. Thus, a snug fit results between the adjacent sections of tabs 64, 65 and tennis net post 12 when auxiliary tennis net post 30 is placed thereon so that auxiliary tennis net post 30 fits snugly over post 12 while still allowing it to pass over the post cap.

A threaded bore 68 is provided in body 34 of auxiliary tennis net post 30 and is positioned at a lower end of tab 64. Wing nut 70 is threadably received by bore 68 and includes a wing head, a threaded body and a base. After body 34 is positioned over tennis net post 12, wing nut 70 is screwed into place with the base of wing nut 70 coming into contact with post 12. Accordingly, auxiliary tennis net post 30 can be fastened to post 12 in a secure fashion. Other types of fastening mechanisms can be used, such as belts, straps, bands or vise arrangements, to name a few, which can releasably fasten auxiliary tennis net posts 30, 32 to tennis net posts 12, 13 in a secure manner. Two additional threaded bores 78, 79 are provided above slot 62 of body 34 and are adapted to receive fasteners which hold auxiliary cleat 48 into place. Alternatively, cleat 48 can be eliminated in which case the cleat 20 of the net post 12 is employed for the same purpose.

Cap 36 of auxiliary tennis net post 30 is cup shaped and is mounted on a top end of body 34 opposite its lower edge 61. Cap 36 includes a cylindrical wall 82 that receives the top end of body 34 and an integral circular top 84. A centrally positioned groove 86 is provided in the top and is aligned parallel to a line passing through slots 60, 62. Groove 86 acts as a guide for cable 46 when it rests upon cap 36. Thus, when cable 46 is tensioned by auxiliary net tensioning mechanism 50, it is aligned parallel to and directly above rope 18 of tennis net 14.

A major difference between auxiliary tennis net post 30 and auxiliary tennis net post 32 is that auxiliary net tensioning mechanism 50 replaces auxiliary cleat 48. Auxiliary net tensioning mechanism 50, as shown in FIGS. 1 and 7, is a standard crank and ratchet assembly and includes a bracket 88 with two plates 90, 92 extending therefrom, a shaft 94 rotatably mounted to plates 90, 92, a gear 96 having pawl teeth attached to shaft 94 intermediate plates 90, 92, a ratchet assembly 98 attached to plate 92 that engages with the pawl teeth of gear 96 and a handle 100 mounted to and end of shaft 94 and positioned adjacent to plate 92. Bracket 88 of the auxiliary net tensioning mechanism 50 is attached to body 34 of auxiliary tennis net post 32 by screws 102, 104. Auxiliary cable 46 is attached to shaft 94 intermediate plates 90, 92 so that when shaft 94 is rotated in a first direction, cable 46 can be tensioned. Likewise, when the shaft 94 is rotated in a second direction, the cable 46 can be loosened. Although a pawl and ratchet auxiliary net tensioning mechanism is shown, any type of net tensioning mechanism can be used to tighten auxiliary net 48.

In operation, auxiliary tennis net post 30 is placed over tennis net post 12 and likewise auxiliary tennis net post 32 is placed over tennis post 13. Auxiliary tennis net posts 30 and 32 are aligned so as to permit cable 18 of tennis net 14 to pass through slots 60, 62. Auxiliary tennis net posts 30, 32 are securely fastened to tennis net posts 12, 13 via tightening the respective wing nuts.

Auxiliary tennis net 42 is then set up so that it partially overlaps tennis net 14 and is connected thereto, such as by snaps 52. This prevents a ball from passing through or prevents the top net to be overly affected by wind. First, one end of cable 46 is tied to auxiliary cleat 48, then it is received by the grooves of caps 36, 40 so that auxiliary tennis net 42 is properly aligned. Finally, the other end of auxiliary rope 46 is fastened to auxiliary net tensioning mechanism 50. Handle 100 of auxiliary tennis net eensioning mechanism 50 is rotated in the first direction and the net is tightened.

It is possible to adjust the height of the auxiliary tennis net 42 after it has been initially set in place. To do so, the auxiliary net 42 and the wing nuts of auxiliary tennis net posts 30, 32 are loosened and the auxiliary tennis net 42 and auxiliary tennis net posts 30, 32 are either raised, as shown by phantom lines in FIG. 1, or lowered, in turn, causing the height of auxiliary tennis net 42 to be increased or decreased.

The tennis net height extender 10 can easily be removed by loosening the respective wing nuts attached to the auxiliary tennis net posts 30, 32 when the tennis net height extender 10 is not needed.

By adjusting the height of net 42, one is able to practice hitting a ball at an elevated height and still keep it in play while visually perceiving a net extending over its full height.

Having described the presently preferred embodiment of my invention, it is to be understood that it may otherwise be embodied within the scope of the appended claims.

I claim:

1. A tennis net height extender adapted to be used with a regulation tennis net and tennis net posts situated within a tennis court comprising:

a pair of auxiliary tennis net posts, each configured and dimensioned to fit over the regulation tennis net posts;

means for releasably fastening said auxiliary tennis net posts adjustably to the tennis net posts so that they extend above the tennis net posts a desired level; and an auxiliary tennis net attached to and between said auxiliary tennis net posts and overlapping the regulation tennis net in a fully extended position.

2. A tennis net height extender as defined by claim 1 wherein each of said auxiliary tennis net posts includes at least one open faced slot extending from a bottom end for accommodating a cable supporting the regulation tennis net.

3. A tennis net height extender as defined by claim 1 including connecting means for intermittently connecting said auxiliary tennis net to the tennis net along their respective lengths.

4. A tennis net height extender as defined by claim 1 wherein each of said auxiliary tennis net posts include a hollow body and a cap, said body having a top end onto which said cap is mounted and a bottom end which can be placed over said tennis net post.

5. A tennis net height extender as defined by claim 4 wherein said hollow body is cylindrical in shape.

6. A tennis net height extender as defined by claim 4 wherein the inner diameter of each of said bodies is greater than the outer diameter of the tennis net posts, each of said bodies further includes means for snuggly holding in place said auxiliary tennis net post onto the tennis net posts.

7. A tennis net height extender as defined by claim 6 wherein said means for snuggly holding in place said auxiliary tennis net post onto the tennis net post include an inwardly facing tab that enables said body to fit snuggly onto the tennis net post.

8. A tennis net height extender as defined by claim 6 wherein said means for snuggly holding in place said auxiliary tennis net post include a plurality of tabs conforming to the outer geometric diameter of the tennis net post so that a snug fit results between said tabs and the tennis net post when said tennis net post is placed thereon.

9. A tennis net height extender as defined by claim 4 further including:

a cleat mounted to a first auxiliary tennis net post to which a first end of said auxiliary cable is attached and an auxiliary net tensioning mechanism attached to a second auxiliary tennis net post to which a second end of said auxiliary rope is attached.

10. A tennis net height extender of claim 9 wherein said tensioning mechanism includes a pawl and ratchet mechanism.

11. A tennis net height extender as defined by claim 4 wherein each of said caps has a top surface with a groove therein, said groove adapted to receive and align a cable attached to said auxiliary net parallel to the tennis net when said auxiliary net is tensioned.

12. A tennis net height extender adapted to be used with a regulation tennis net and tennis net posts situated within a tennis court, comprising:

a pair of auxiliary tennis net posts each configured and dimensioned to fit over the regulation tennis net posts and each including a body and a cap, said body having a top end onto which said cap is mounted, a bottom end which can be placed over the tennis net post and at least one open faced slot extending from said bottom end of said body adapted to permit a cable attached to the tennis net to pass therethrough;

means for fastening said auxiliary tennis net posts adjustably to the tennis net posts; and an auxiliary net having an upper longitudinal edge attached to said auxiliary tennis net posts and overlapping the regulation tennis net in a fully extended position.

13. A tennis net height extender as defined by claim 12 wherein each of said bodies is hollow and cylindrically shaped and has two axially aligned open faced slots positioned across from each other that extend vertically from said bottom end of said body and are adapted to permit the cable attached to the tennis net to pass through said body.

14. A tennis net height extender as defined by claim 12 including connecting means for intermittently connecting said auxiliary tennis net to the tennis net along their respective lengths.

15. A tennis net height extender as defined by claim 12 wherein the inner diameter of each of said bodies is greater than the outer diameter of the tennis net posts, said body further including means for snuggly holding in place said auxiliary tennis net post onto the tennis net posts.

16. A tennis net height extender as defined by claim 15 wherein said means for snuggly holding in place said auxiliary tennis net post onto the tennis net post include a tab mounted to the bottom end of said body that enables said bottom end of said auxiliary tennis net post to fit snuggly onto the tennis net post.

17. A tennis net height extender as defined by claim 15 wherein said means for snuggly holding in place said auxiliary tennis net post onto the tennis net post include a plurality of tabs mounted to the bottom end of said body conforming to the outer geometric diameter of the tennis net post so that a snug fit results between said tabs and the tennis net post when said auxiliary tennis net post is placed thereon.

18. A tennis net height extender adapted to be used with a regulation tennis net and tennis net posts situated within a tennis court comprising:

a first auxiliary tennis net post and a second auxiliary tennis net post each of said posts including a cylindrical hollow body, two tabs and a cap, said body having a top end onto which said cap is mounted, a bottom end which can be placed over the tennis net post and two axially aligned open faced slots positioned across from each other that vertically extend from said bottom end of said body and adapted to permit a cable attached to the tennis net to pass therethrough, said tabs attached to said bottom end of said body positioned across from each other and intermediate of said slots and conform to the outer geometric diameter of the tennis net post so that a snug fit results between said tabs and the tennis net post when said auxiliary tennis net post is placed thereon and thereby snuggly holding said auxiliary tennis net post in place;

means for fastening said auxiliary tennis net posts adjustably to the tennis net posts; and an auxiliary tennis net having an upper longitudinal edge attached to said auxiliary tennis net posts by means of an auxiliary cable and said auxiliary tennis net overlapping the regulation tennis net in a fully extended position, one end of said auxiliary cable attached to a cleat that is mounted to said first auxiliary tennis net post and another end of said auxiliary rope attached to a net tensioning mechanism mounted to said second auxiliary tennis net post.

19. A tennis net height extender as defined by claim 18 wherein each of said caps has a top surface with a groove therein, said groove is adapted to receive and align said auxiliary rope attached to said auxiliary tennis net so that when said auxiliary tennis net is tensioned, it is aligned parallel to the tennis net.

20. A tennis net height extender as defined by claim 18 including connecting means for intermittently connecting said auxiliary tennis net to the tennis net along their respective lengths.

* * * * *